United States Patent [19]

Saccucci

[11] 4,436,990

[45] Mar. 13, 1984

[54] COUNTING DEVICE

[76] Inventor: Michael R. Saccucci, 445 Pineda St., Cocoa, Fla. 32922

[21] Appl. No.: 399,883

[22] Filed: Jul. 16, 1982

[51] Int. Cl.[3] ..... G06C 27/00

[52] U.S. Cl. ..... 235/1 R; 235/69; 33/169 B

[58] Field of Search ..... 235/94 R, 85 R, 1 R, 235/69; 221/6; 33/126.7 R, 169 B

[56] References Cited

U.S. PATENT DOCUMENTS

| | | | |
|---|---|---|---|
| 197,839 | 6/1877 | Edmunds, Jr. . | |
| 922,152 | 9/1909 | Kent . | |
| 1,564,964 | 8/1923 | Knieling . | |
| 2,400,371 | 11/1944 | Reeser . | |
| 2,639,207 | 5/1953 | Ziska | 221/6 X |
| 3,277,905 | 8/1965 | Thompson . | |
| 3,672,061 | 7/1972 | Alessi | 33/169 B |
| 3,964,170 | 5/1976 | Zdarsky | 33/169 B |
| 4,214,368 | 1/1980 | Peterson | 33/126.7 R |
| 4,216,585 | 8/1980 | Hatter | 33/169 B |

*Primary Examiner*—Benjamin R. Fuller
*Attorney, Agent, or Firm*—Browdy and Neimark

[57] ABSTRACT

A cup counting device for use in open ended tubular dispensing devices, the device having a plurality of reverse scales extending towards the center of the device from the ends thereof, each scale being calibrated for a particular size and type of cup and for a particular cup dispensing device. When the invention device is inserted into the dispenser pushing the appropriate cups therein to the minimum compressed length of the column of cups and of the spring dispensing means in the dispenser, the end of the dispenser reads against the scales on the counter directly in number of cups remaining in the dispenser.

7 Claims, 6 Drawing Figures

COUNTING DEVICE

FIELD OF THE INVENTION

This invention relates to a counting device and more in particular pertains to a calibrated rod or scale for counting the number of cups in a spring loaded cup dispensing tube.

BACKGROUND OF THE INVENTION

In fast food operations, the inventory function as to beverages is often accomplished by means of counting the cups. Thus, it is necessary on a daily basis, to count the number of cups remaining so as to determine the number of cups of beverage sold. Prior to the invention, this entailed a great deal of wasted man hours in removing the cups from the dispensing tubes for the purpose of counting them, and then putting the cups back into the cup dispensing tubes for use the next business day. The present invention completely eleminates this wasted effort by providing a device of the character described to count the cups while they are in the cup dispensing tube.

The term "cup dispensing tube" as used in the specification and claims herein shall be understood to mean that sort of device, which is typically fixed to the wall, is of elongated tubular shape, has a predetermined length, and has a spring means mounted in the upper end between the closed off upper end and the top of the column of cups in the tube. Means are provided at the lower end of the tube to allow the food sellers to rapidly peel off and pull out one cup at a time from the bottom open end of the dispenser.

DISCUSSION OF THE PRIOR ART

Counting devices, ullage sticks, and devices of this general character are very well known; i.e., this art is highly developed. For example, sticks to measure liquid in tanks calibrated in units of liquid volume, coin counting devices, pill counting devices, and many such methods and apparatus are well known to those skilled in these arts. Further, some specific examples of such devices are set forth and described with particularity in the reference identified in the disclosure statement filed in this application.

However, the prior art has not taught a device, particularly custom sized to a particular cup dispensing tube as well as to many different sizes of cups which could be dispensed from such cup dispensing tubes, like the invention.

SUMMARY OF THE INVENTION

The invention comprises a stick or rod having no moving parts, of rectilinear cross-sectional shape, and provided with up to eight different scales, four depending from each of the four sides down from each of the two ends of the device. In the environment in which the invention is used, the cup dispensing tubes are of a fixed and predetermined length. It is this facet, a feature of the combination of the invention, which permits the invention's steps forward in this art.

The invention preferably comprises a combination of three pieces of wood, two end pieces which may be cut from ply-wood, and a center rectilinear cross-section stick calibrated in differing amounts of different sizes of cups mounted in the standard length cup dispensing tube. The scales are preferably provided by making simple cuts or kerfs in the sides of the stick to thereby provide scales which would not wear off in use, which can withstand rough handling and significant quantities of dirt, greasy hands, and the like while still remaining fully functional.

Thus, there is provided a device of the character described which is simple and inexpensive to manufacture, strong and durable, and highly suited to its intended use in a highly advantageous manner. Further, a problem in the fast food industry of inventory control of drinking cups, heretofore completely unsolved, is solved by the invention in a simple and straightforward manner using the device of the character described.

BRIEF DESCRIPTION OF THE DRAWINGS

The above and other advantages of the invention will be pointed out or will become evident in the following detailed description and claims, and in the accompanying drawing also forming a part of the disclosure, in which:

Figure 6:
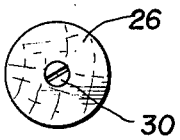

and,

FIG. 6 is an end view of the device.

DETAILED DESCRIPTION OF THE PREFERRED EMBODIMENT

Figure 1:
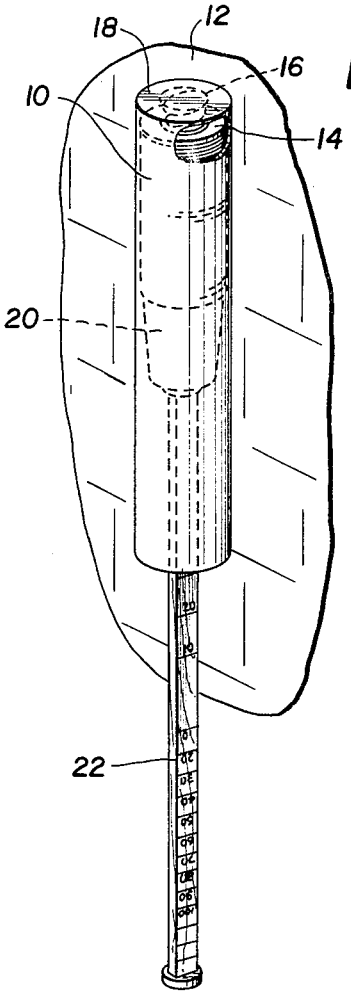
FIG. 1 is a perspective view showing the invention in use counting cups in a cup dispensing tube mounted on a wall.
Figure 2:
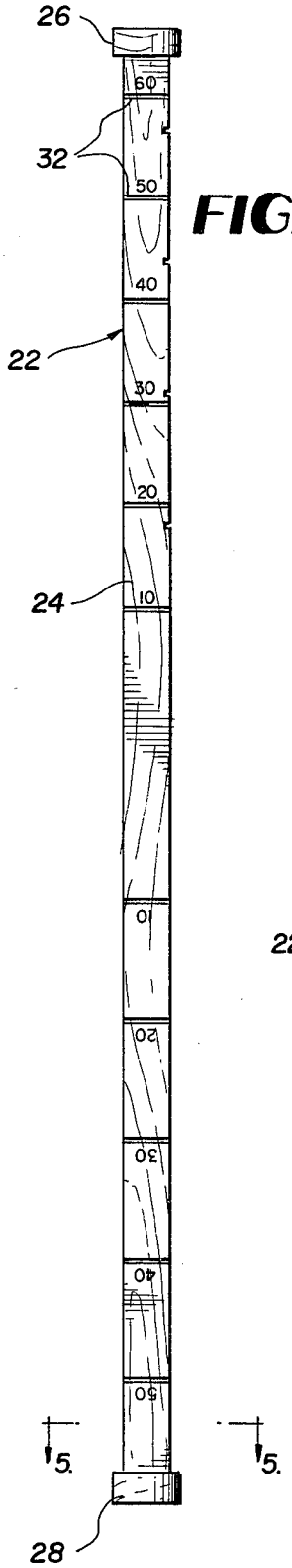
FIG. 2 is a front elevational view of the invention device.
Figure 3:
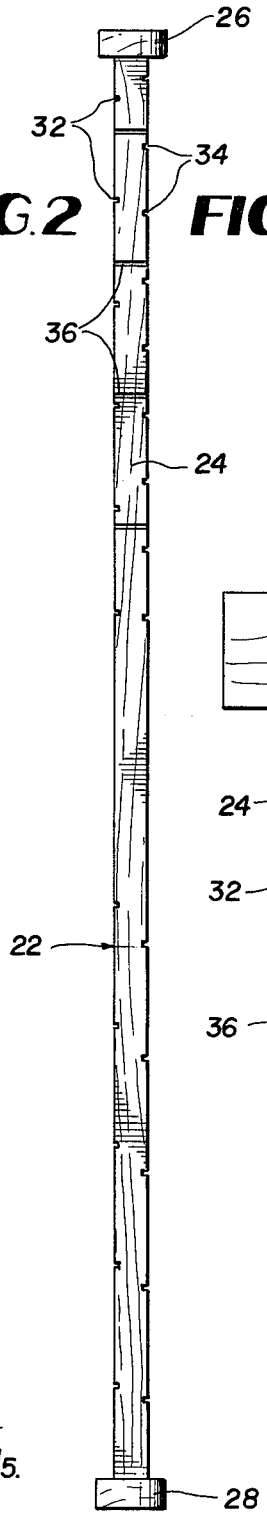
FIG. 3 is a side elevational view taken at right angles to the showing of FIG. 2.

Referring to FIG. 1, there is shown a cup dispensing tube device 10 which is fixed to a wall 12 by suitable means not shown. Device 10 includes a plate 14 which is urged by a spring 16 toward its lower open end. The spring 16 is trapped between the closed top end 18 of the cup dispensing device 10, and the plate 14. Other means, not shown, to prevent the spring and plate 16 and 14 from completely dropping out of the open end of the of the tube 10 are provided.

A column of cups 20 of conventional design and type as used in fast-food operations is mounted in the tube device 10, and is urged towards the lower end by the assemblage by the spring and plate 16 & 14. Means not shown are provided at the lower open end of the tube device 10 to prevent all of the cups from exiting all at once, and to permit users to remove the cups out of the column of cups 20 one at a time.

The invention counting device 22 is shown, in greater detail in FIGS. 2 through 6, and in use counting the cups in the device 10 in FIG. 1.

Device 22 comprises a center stick or rod member 24, to which are fixed a pair of end members 26 and 28. In order to not damage the cups against which the end members and 26 and 28 bear in use, the joining is accomplished, preferably, by means of a screw 30 countersunk in the end member, as shown in FIG. 6.

Figure 4:
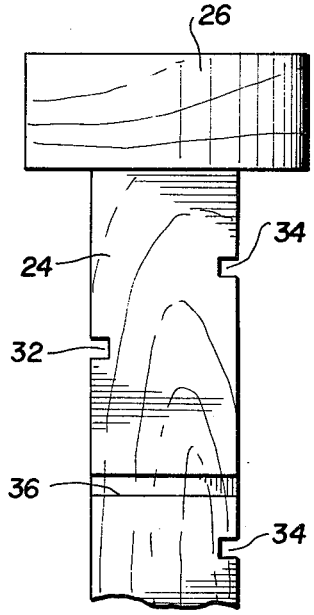
FIG. 4 is an enlarged showing of the top end of the device as shown in FIG. 2.
Figure 5:
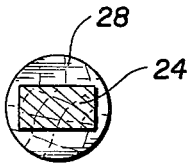
FIG. 5 is a cross-sectional taken on line 5—5 of FIG. 2.

Means are provided to calibrate the shaft 24 in accordance with differing numbers of cups and in accordance with differing cup dispensing devices 10, or in accordance with both differing numbers of cups and differing numbers of dispensing devices. As shown in FIG. 5, the shaft 24 is of rectilinear cross-sectional shape. Thus, it presents eight surfaces, four depending down from the end member 26 and another set of four depending down from the end member 28, all or some of which eight surfaces can be calibrated for these different purposes. Referring to FIG. 4, three of the sets of calibrations, the saw cuts or kerfs 32, 34, and 36 are illustrated. Some of the sets of kerfs or calibrations are marked, see FIGS. 1 and 2.

Further, it is within the teaching of the invention, to provide for more or fewer scales. For example, the shaft 24 could be made of hexagonal cross-sectional shape, and thus up to twelve scales could be provided. Further, counting devices embodying the invention can be contemplated wherein only one end would be used, or wherein the material could be other than the simple wooden devices used in the invention as thus far constructed and shown in the drawings. All of such variations and the like are of course contemplated within the teachings of the invention.

As is shown, the scales are in reverse order, that is the numbers go down from the ends towards the middle. In this manner, the number of cups remaining in the device 10 is indicated directly. Further, the scales are custom tailored or specifically cut or designed for a particular length of cup counting device 10, length being measured along the column of cups 20. That is, for a particular size, a cup counting device 10 which is six inches longer than another cup counting device for which this particular scale has been designed, would give an erroneous reading, too few cups would be indicated in such case. Likewise, the compressed length of the spring 16 or equivalent means together with the thickness of the plate 14 must be accommodated by the particular scales used on the sides or surfaces of the shaft 24. The thickness of the end plate 26 must likewise be included in the calibrating of the invention device for a particular application. Because of the simplicity with which the scales are provided on the shaft 24 of the invention counting device 22, this custom calibration is easily accomplished, and a single tool useful for all of the cup counting needs of a particular fast-food chain, not just a single store but the entire chain, is rather easily provided. Suitable legends on the various scales, not shown in the drawings, can also be easily provided; e.g., "shakes", "large drinks", "small drinks", and the like.

As indicated generally in FIG. 1 and as is common in this art, the column of cups 20 are of course a nested column of cups so as to occupy a minimum space. However, the axial length of the column of cups will of course, depend upon the size and type of the cups themselves, and this facet, likewise, is considered in the calibration of the scales on the shaft 24 of the invention device 22.

In use, again as indicated in FIG. 1, the end of the tube member 20, the length of which has been accommodated in the calibrations in the particular scales in use on the shaft 24 of the invention device, when the shaft is used to push the column of cups against the spring 16 to urge the assembly of the column of cups and the spring to their compressed length, will read out directly in number of cups in the column 20 when viewed along the bottom edge of the cup dispensing device 10.

While the invention has been described in detail above, it is to be understood that this detailed description is by way of example only, and the protection granted is to be limited only within the spirit of the invention and the scope of the following claims.

I claim:

1. A device for counting the cups remaining inside a tubular cup dispensing device, said device being of the type which has an open lower end and means at said open lower end to permit one at a time dispensing of cups in a nested column of cups inside said device while preventing the entire nested column of cups from falling out of said cup dispensing device all at once, said cup dispensing device comprising a closed upper end and spring means to normally urge the column of cups therein towards said open lower end, said counting device comprising a shaft and at least one end member fixed at one end of said shaft, at least one scale means on said shaft starting from said at least one end member and extending along said shaft away from said end member, said counting device being so sized as to fit into said open lower end of said cup counting device with said end member in contact with the lowermost one of said column of nested cups, said shaft having a length sufficiently long to permit use of said shaft to push via said end member against said column of cups and to compress said spring means to its fully compressed minimum length; and each of said at least one scale means being calibrated for all of a particular size and type of cup and for a particular length of cup counting device and spring means therein; whereby the lower end of said cup counting device will be positioned with respect to said scale means in the said fully compressed minimum length position of said column of cups and of said spring means to read directly in number of said particular size and type of cups in said particular cup counting device.

2. The device of claim 1, said cup counting device comprising a shaft of rectilinear cross-sectional shape, and a plurality of said scale means on respective ones of the plurality of surfaces of said shaft created by the rectilinear cross-sectional shape of said shaft.

3. The combination of claim 1, said counting device comprising an end member on each of the two ends of said shaft, and at least one scale means extending from each of said end members inwardly towards each other along said shaft.

4. The combination of claim 3, said counting device comprising said shaft, said pair of end members, and means to fix said end members to the ends of said shaft, said shaft and said end members consisting entirely of wood.

5. The combination of claim 3, said counting device shaft being of rectilinear cross-sectional shape, whereby up to eight different scale means can be provided on said shaft extending four from each of the two end members thereon.

6. The combination of claim 1, said counting device shaft consisting of wood, and said scale means comprising a plurality of spaced kerfs cut into the wood of said shaft at predetermined spaced positions with respect to said end members so as to constitute said scale means.

7. The combination of claim 1, said counting device shaft consisting of a wooden member of rectilinear cross-sectional shape, a second end member on the other end of said shaft, whereby up to four of said scale means can be provided on the surfaces of said shaft four each extending from each member towards each other along said shaft, and each of said at least one scale means comprising a plurality of spaced kerfs cut into said surfaces of said shaft.

* * * * *